US009032900B2

(12) United States Patent
Glezer et al.

(10) Patent No.: US 9,032,900 B2
(45) Date of Patent: May 19, 2015

(54) MARINE VEHICLE SYSTEMS AND METHODS

(71) Applicants: Ari Glezer, Atlanta, GA (US); Lora G. Weiss, Atlanta, GA (US); Mark G. Allen, Atlanta, GA (US)

(72) Inventors: Ari Glezer, Atlanta, GA (US); Lora G. Weiss, Atlanta, GA (US); Mark G. Allen, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 40 days.

(21) Appl. No.: 13/870,050

(22) Filed: Apr. 25, 2013

(65) Prior Publication Data

US 2013/0305978 A1 Nov. 21, 2013

Related U.S. Application Data

(60) Provisional application No. 61/638,138, filed on Apr. 25, 2012.

(51) Int. Cl.

| | |
|---|---|
| ***B63G 8/26*** | (2006.01) |
| ***B63G 8/00*** | (2006.01) |
| ***B63G 8/08*** | (2006.01) |
| ***B63G 8/14*** | (2006.01) |
| ***B63H 1/30*** | (2006.01) |
| *B63H 1/37* | (2006.01) |
| *B63G 8/18* | (2006.01) |
| *B63H 1/36* | (2006.01) |
| *B63B 7/08* | (2006.01) |
| *B63G 13/02* | (2006.01) |

(52) U.S. Cl.

CPC ... *B63G 8/26* (2013.01); *B63H 1/37* (2013.01); *B63G 8/001* (2013.01); *B63G 8/08* (2013.01); *B63G 8/14* (2013.01); *B63G 8/18* (2013.01); *B63H 1/30* (2013.01); *B63H 1/36* (2013.01); *B63B 2211/02* (2013.01); *B63G 2008/002* (2013.01); *B63B 7/08* (2013.01); *B63G 2013/022* (2013.01)

(58) Field of Classification Search

CPC ..... B63G 8/26
USPC ..... 114/330, 321, 312; 440/13–15
See application file for complete search history.

(56) References Cited

U.S. PATENT DOCUMENTS

| | | | | |
|---|---|---|---|---|
| 3,803,544 | A * | 4/1974 | Wallen et al. | 367/172 |
| 5,120,099 | A * | 6/1992 | Fletcher | 294/66.1 |
| 5,194,029 | A * | 3/1993 | Kinoshita | 446/35 |
| 5,235,931 | A * | 8/1993 | Nadolink | 114/321 |
| 5,378,018 | A * | 1/1995 | Ketterer et al. | 280/737 |
| 5,574,246 | A * | 11/1996 | Meyers et al. | 114/20.2 |
| 5,673,645 | A * | 10/1997 | Bandyopadhyay | 114/312 |
| 5,704,309 | A * | 1/1998 | Kohnen | 114/312 |
| 5,798,156 | A * | 8/1998 | Mitlitsky et al. | 428/35.9 |
| 6,276,294 | B1 * | 8/2001 | Geriene et al. | 114/312 |
| 6,321,676 | B1 * | 11/2001 | Kohnen et al. | 114/312 |
| 6,474,255 | B2 * | 11/2002 | Geriene et al. | 114/312 |

(Continued)

*Primary Examiner* — Lars A Olson
*Assistant Examiner* — Jovon Hayes
(74) *Attorney, Agent, or Firm* — Troutman Sanders LLP; Ryan A. Schneider; Benjamin C. Wiles

(57) ABSTRACT

Marine vehicle systems and methods are disclosed. The marine vehicle can be buoyancy controlled, enabling efficient, extended use of the marine vehicle. Buoyancy actuation can enable roll, pitch, and yaw of the marine vehicle, as well as translation in any direction. One or more elastic bladders can be disposed on or in the marine vehicle. The bladders can be selectively inflated and deflated to control movement of the marine vehicle.

20 Claims, 9 Drawing Sheets

(56) References Cited

U.S. PATENT DOCUMENTS

| | | | | |
|---|---|---|---|---|
| 6,558,218 | B1 * | 5/2003 | Hansen | 441/80 |
| 6,571,725 | B1 * | 6/2003 | Lee | 114/288 |
| 6,575,114 | B2 * | 6/2003 | Sandler et al. | 114/315 |
| 6,845,728 | B1 * | 1/2005 | Horton | 114/244 |
| 6,886,469 | B2 * | 5/2005 | Shilliday et al. | 102/530 |
| 6,974,356 | B2 * | 12/2005 | Hobson et al. | 440/13 |
| 7,261,607 | B1 * | 8/2007 | Klimenko | 441/65 |
| 7,316,197 | B2 * | 1/2008 | Herrmann | 114/312 |
| 7,500,442 | B1 * | 3/2009 | Schanz | 114/256 |
| 7,670,121 | B2 * | 3/2010 | Weatherbee | 418/68 |
| 7,740,418 | B2 * | 6/2010 | Adams | 405/186 |
| 8,020,722 | B2 * | 9/2011 | Richards et al. | 220/584 |
| 8,317,555 | B2 * | 11/2012 | Jacobsen et al. | 440/12.63 |
| 8,322,296 | B2 * | 12/2012 | Tiraby et al. | 114/337 |
| 8,323,062 | B2 * | 12/2012 | Bannasch et al. | 440/15 |
| 8,381,672 | B1 * | 2/2013 | Eriksen | 114/333 |
| 8,601,928 | B2 * | 12/2013 | Martinez et al. | 89/1.34 |
| 8,683,937 | B2 * | 4/2014 | Sancoff | 114/312 |
| 8,714,070 | B2 * | 5/2014 | Martinez et al. | 89/1.34 |
| 8,726,827 | B1 * | 5/2014 | Eriksen | 114/333 |
| 2006/0205544 | A1 * | 9/2006 | Wyner et al. | 473/569 |
| 2013/0305978 | A1 * | 11/2013 | Glezer et al. | 114/321 |

* cited by examiner

MARINE VEHICLE SYSTEMS AND METHODS

CROSS-REFERENCE TO RELATED APPLICATIONS

This application claims priority under 35 U.S.C. §119(e) to U.S. Provisional Patent Application Ser. No. 61/638,138, filed 25 Apr. 2012, the entire contents and substance of which are hereby incorporated by reference as if fully set forth below.

BACKGROUND

1. Field of the Invention

Various embodiments of the present invention relate to marine vehicles, and more particularly, to buoyancy controlled marine vehicles.

2. Background of Related Art

Although underwater environments are more diverse than those on land, difficulties associated with gathering underwater data has severely limited our knowledge of these habitats. In fact, many experts agree that the difficulty in assessing some underwater environments is commensurate in scope with many space missions. While space exploration has been able to rely on numerous unmanned missions, however, most oceanic monitoring and exploration is still performed by manned vehicles, and is often constrained by the limitations of these vehicles.

A variety of marine vehicles have been developed to explore underwater environments. The great majority of these vehicles are, or have evolved from, rigid-hull submersibles. The deployment and effectiveness of these vehicles has been severely limited, however, by the need to incorporate long tethered cables to a mother ship, propellers that become entangled and snarled in sea grass or debris, and rigid hulls that prevent maneuvering in close proximity to fragile ocean features, such as arctic ice or coral reefs, for fear of damaging the environment.

In addition, traditional marine vehicles are often complex machines that are mechanically propelled and require large amounts of fuel or heavy batteries to function. The use of fuel and heavy batteries for mechanical propulsion can limit the length of the vehicles' missions, as the fuel quickly runs out and the batteries quickly die. These shortcomings necessitate a different approach to oceanographic exploration.

Some researchers have developed vehicles that use buoyancy and gravity to yield locomotion, instead of fuel and batteries. In these designs, a torpedo shaped vehicle can be angled forward and downward in the water, and the buoyancy of the vehicle can be reduced. The vehicle then descends, and the forward angle causes the vehicle to move forward and downward at a given glide path. When the vehicle reaches a predetermined depth, the buoyancy can be increased, causing the vehicle to rise toward the surface of the water. A forward angle can be maintained during this ascent, again causing the vehicle to move forward in addition to upward at a given glide path. When the vehicle reaches a predetermined depth, its buoyancy can be decreased and the first forward angle reinstated, again causing the vehicle to move forward and downward. This process can be repeated until the vehicle moves a desired distance or to a desired location.

The buoyancy vehicles described above have several disadvantages. First, constant depth cannot be maintained, since depth change is necessary to impart movement. Second, side to side movement is difficult or impossible to impart without adding complex components. Third, the vehicles are heavily influenced by oceanic currents, since they generally have difficulty modifying their trajectories to compensate for the flow of the water. These disadvantages make the vehicles poorer choices for oceanic exploration, as they have very limited capabilities.

To overcome these limitations, a number of researchers have explored vehicles that are based on biomimicry of batoids, such as rays or skates. Live batoids have superior hydrodynamic characteristics and make extremely efficient use of energy. They also have excellent underwater movement capabilities. Known vehicles that imitate batoids, however, are mechanically actuated, and locomotion and maneuvering of these designs have been limited by the high complexity and power consumption of their actuators. More specifically, movement of flexible portions of the vehicles, such as their fins, has been limited by the availability and reliability of known mechanical designs as well as the amount of energy that is required to actuate these designs.

What is needed, therefore, is an efficient vehicle suitable for extended underwater missions. The vehicle can use buoyancy to effectively control its motion, but should do so in a manner that provides desirable locomotion and maneuvering capabilities. In some embodiments, the vehicle should mimic a batoid. It is to such a system that embodiments of the present invention are primarily directed.

SUMMARY

Briefly described, embodiments of the present invention can comprise a marine vehicle. The marine vehicle can be buoyancy actuated, enabling highly efficient, extended use of the marine vehicle. Buoyancy actuation can be used, for example, to enable roll, pitch, and yaw of the marine vehicle, as well as translation in any direction. In some embodiments, the marine vehicle can comprise one or more fins, which can be flapped to impart motion to the marine vehicle. Accordingly, in some embodiments, the marine vehicle can biomimic a batoid.

Embodiments of the present invention can comprise one or more elastic bladders disposed on or in the marine vehicle. The bladders can be selectively inflated and deflated to control movement of the marine vehicle. For example, to cause a fin of the marine vehicle to rise in the water, one or more bladders on the fin can be inflated. To enable the fin to descend in the water, one or more bladders on the fin can be deflated.

Various systems and methods can be used to inflate and deflate the bladders. In some embodiments, for example, to inflate a bladder, compressed gas can be delivered to the bladder. In some embodiments, however, a chemical reaction can be used to inflate the bladder. More specifically, an azide, such as sodium azide, can be disposed within the bladder. Heat or an electric charge can then be delivered to the azide, causing the azide to undergo a state transformation to gas, and enabling inflation of the bladders. One or more valves can be activated to deflate the bladders.

Embodiments of the present invention can comprise a marine vehicle comprising a body and a plurality of inflatable bladders. In some embodiments, at least one bladder of the plurality of inflatable bladders can be configured to be inflated underwater to control movement of the marine vehicle.

In some embodiments, at least one bladder of the plurality of inflatable bladders can be configured to be inflated underwater to control the roll of the marine vehicle. In some embodiments, at least one bladder of the plurality of inflatable bladders can be configured to be inflated underwater to control the pitch of the marine vehicle. In some embodiments, at least one bladder of the plurality of inflatable bladders can comprise an elastic material. In some embodiments the marine vehicle can further comprise an azide disposed within at least one bladder of the plurality of inflatable bladders.

Embodiments of the present invention can also comprise a marine vehicle comprising a body and a plurality of control surfaces, and at least one control surface of the plurality of control surfaces can comprise an inflatable bladder. In some embodiments, the inflatable bladder can be inflated underwater to control movement of the control surface.

In some embodiments, the marine vehicle can further comprise an azide disposed within the inflatable bladder. In some embodiments, heat can be provided to the azide to cause at least a portion of the azide to transform to a gaseous state.

In some embodiments, the marine vehicle can further comprise a canister of compressed gas, and the marine vehicle can be configured to deliver at least some of the gas from the canister to the inflatable bladder.

In some embodiments, the marine vehicle can comprise a valve in fluid communication with the inflatable bladder. In some embodiments, the marine vehicle can comprise a payload compartment. In some embodiments, the marine vehicle can comprise a cover disposed over at least one control surface of the plurality of control surfaces.

In some embodiments, the marine vehicle can further comprise a control system configured to selectively inflate and deflate the inflatable bladder. In some embodiments, the control system can selectively inflate and deflate the inflatable bladder based at least in part on a desired trajectory for the marine vehicle. In some embodiments, at least two of the control surfaces are flappable fins. In some embodiments, the marine vehicle can be rolled and inserted into a storage container.

Embodiments of the present invention can also comprise a marine vehicle comprising a body and a plurality of flappable fins each comprising a plurality of inflatable bladders. In some embodiments, at least one bladder of the plurality of inflatable bladders can be inflated underwater to control a flapping motion of a fin.

In some embodiments, at least one fin of the plurality of flappable fins cam be configured to flap in an undulation-type motion. In some embodiments, at least one fin of the plurality of flappable fins can be configured to flap in an oscillation-type motion. In some embodiments, the marine vehicle can further comprise an azide disposed within each of the inflatable bladders, and the marine vehicle can be configured to deliver heat to each of the azides to cause at least a portion of each azide to transform to a gaseous state.

These and other objects, features, and advantages of the present invention will become more apparent upon reading the following specification in conjunction with the accompanying drawing figures.

DETAILED DESCRIPTION

Figure 1:
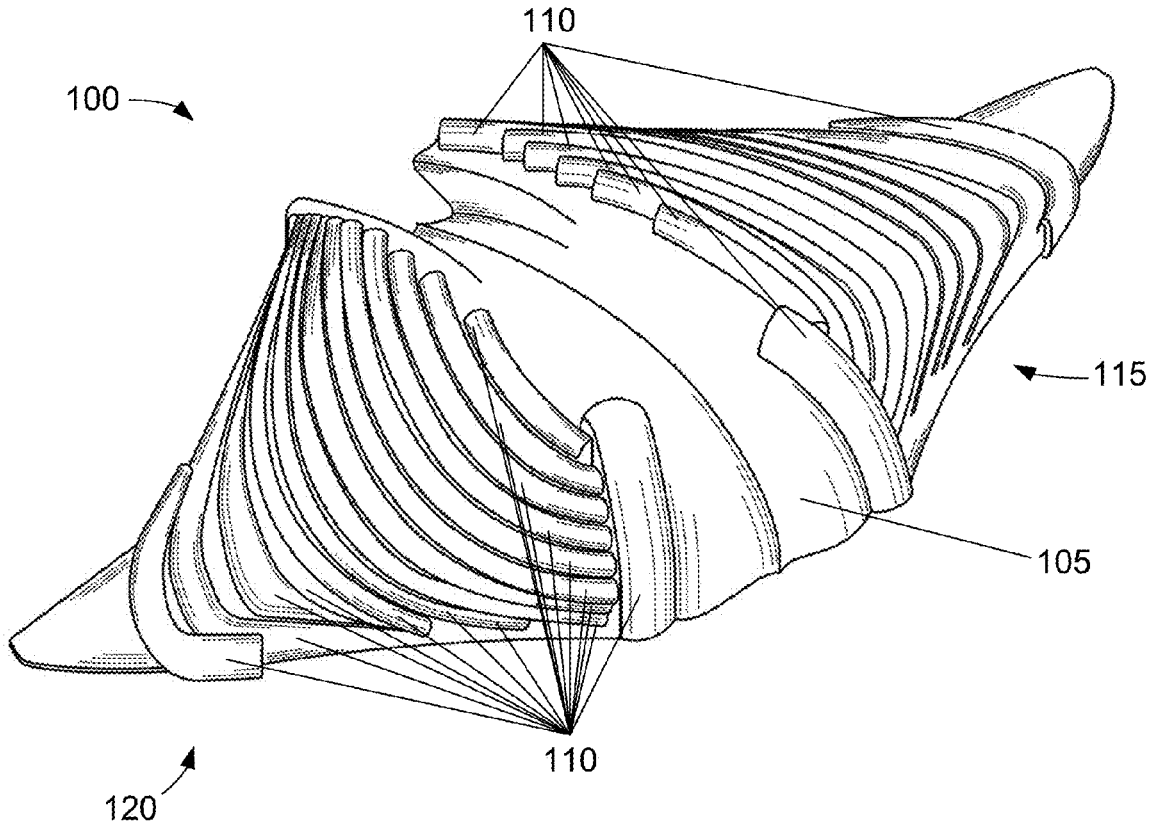
FIG. 1 depicts a marine vehicle comprising inflatable bladders, in accordance with some embodiments of the present invention.

To facilitate an understanding of the principles and features of the various embodiments of the invention, various illustrative embodiments are explained below. Although exemplary embodiments of the invention are explained in detail as being marine vehicle systems and methods, it is to be understood that other embodiments are contemplated, such as embodiments employing other types of vehicles, marine systems, or methods of marine transportation. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of the present invention, various illustrative embodiments are explained below. In particular, various embodiments of the present invention are described as marine vehicle systems and methods. Some aspects of the invention, however, may be applicable to other contexts, and embodiments employing these aspects are contemplated. For example and not limitation, some aspects of the invention may be applicable to various types of marine transports, flying vehicles, and/or methods of marine transportation, or other types of vehicles altogether. Accordingly, where terms such as "marine" or "vehicle" or related terms are used throughout this disclosure, it will be understood that other devices, entities, objects, or activities can take the place of these in various embodiments of the invention.

Moreover, when a vehicle is described as an "underwater vehicle," is will be understood that the vehicle can be used in salt water or fresh water or fluids other than water, and that these applications and embodiments are within the scope of this disclosure. Additionally, when a bladder is described as being inflated or deflated, it will be understood that these terms can refer to wholly or partially inflated or deflated bladders.

As described above, a problem with existing marine vehicle systems and methods is that they are mechanically propelled, and their fuel quickly runs out or their batteries quickly die. These shortcomings significantly limit the maximum length of the vehicles' missions. Accordingly, it is desirable to design vehicles that use buoyancy to control movement, instead of mechanical systems, as buoyancy-controlled vehicles can be more efficient. However, known buoyancy controlled systems have several drawbacks, including inability to maintain a constant depth, inability to move side to side, and inability to overcome currents in the water. The present invention, however, can comprise a buoyancy controlled marine vehicle that overcomes these disadvantages.

The present invention, for example, can be a scalable marine vehicle inspired by the morphology, control surfaces, and three-dimensional maneuvering capabilities of batoids. In some embodiments, buoyancy control can be used to simulate batoid movement, and can replace mechanical actuation. This can be accomplished, for example, by using control surfaces activated by inflatable bladders.

In some embodiments, the marine vehicle can be capable of enduring prolonged missions without the need to refuel. More specifically, in some embodiments, the marine vehicle can provide six months or more of service autonomously, without refueling. This ability to provide prolonged use is a significant advantage over known systems.

Embodiments of the present invention can have the further benefits of being nearly silent, since there are limited or no mechanical components that generate underwater noise. This reduced acoustic signature can be particularly important for any military applications where avoidance of detection can be vital. Moreover, the present invention can carry payloads, such as sensors, weapons, cargo, or other objects and devices. Accordingly, embodiments of the present invention can deliver a payload, such as a sensor, with very low chance of detection. Moreover, embodiments of the present invention can be configured to "hitch-hike" on other marine vehicles, such as submarines, without being detected.

In addition, embodiments of the present invention, and implementation of the present invention, aim to (i) expand the frontier of marine robotic science and sampling for co-exploration of the oceans, (ii) increase the pool of researchers in marine-application-inspired robotics who can productively collaborate across the multiple robotic disciplines of autonomy, computational modeling, cognitive interactions, mechanical design, and ocean sciences, and (iii) create a synergy of partners, technologies, and disciplines with strong potential for commercial transition.

Figure 3:
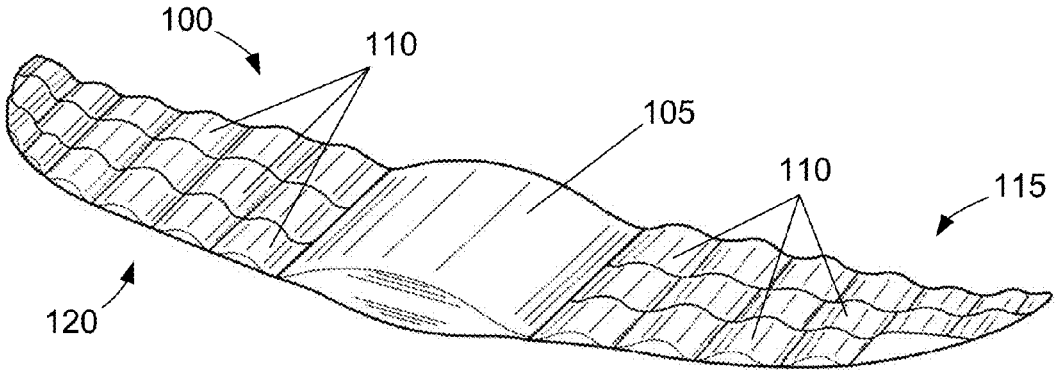
FIG. 3 depicts another marine vehicle comprising inflatable bladders, in accordance with some embodiments of the present invention.

As shown in FIGS. 1 and 3, embodiments of the present invention can comprise a marine vehicle 100. In some embodiments, to reduce complexity, and reduce the amount of energy required to power the marine vehicle 100, the marine vehicle 100 can be buoyancy controlled. Moreover, as shown in FIGS. 1 and 3, the marine vehicle 100 can resemble a batoid, such as a ray or a skate. Accordingly, the marine vehicle 100 can have hydrodynamic characteristics of a batoid, such as efficient movement through the water in multiple directions, high maneuverability, and a sleek hydrodynamic profile that enables extended duration missions and minimizes energy consumption. Moreover, the dorso-ventrally flattened shape of a batoid facilitates implementation of buoyancy-driven locomotion and allows for fine control and maneuverability. In some embodiments, as shown in FIG. 1, the marine vehicle 100 can resemble a manta ray.

In some embodiments, the marine vehicle 100 can comprise a body 105. The body 105 can serve multiple functions. First, the body 105 can have a sleek hydrodynamic profile, once again improving the efficiency of the marine vehicle 100. In addition, the interior of the body 105 can provide one or more cavities. These cavities can house electrical components of the marine vehicle 100 such as, for example and not limitation, control electronics, sensing hardware, and monitoring hardware. Moreover, the cavities can provide a payload compartment for any payloads transported by the marine vehicle 100. In some embodiments, the cavities can be sealable, such that the cavities are configured to remain dry when the marine vehicle is underwater. In some embodiments, one or more of the cavities can be selectively opened and closed underwater, such that a payload can be inserted into, or taken out of, the marine vehicle 100 while the marine vehicle 100 is in use.

In some embodiments, the body 105 can be rigid, such that it can provide enhanced structural support to the marine vehicle 100. In some embodiments, however, the body 105 can be flexible. A flexible body 105 can improve the maneuverability of the marine vehicle, reduce the potential harm to the environment if the body 105 should contact coral, arctic ice, or other delicate marine structures, and enable the marine vehicle 100 to be easily transported in a storage container, as described in more detail below.

As shown in FIGS. 1-3, 7*a*-7*b*, and 9, in some embodiments, the marine vehicle 100 can comprise one or more inflatable bladders 110. As described above, one problem with conventional marine vehicles is that they are mechanically complex. This is especially true with marine vehicles that attempt to biomimic batoids. The marine vehicle 100 of the present invention, however, can greatly reduce mechanical complexity by incorporating one or a plurality of inflatable bladders 110. The marine vehicle 100 can use the surrounding environment, i.e., the water, to effect a distribution of forces on the bladders 110, thereby enabling movement and control of the marine vehicle 100. Moreover, the bladders 100 enable relatively simple systems to have large, global effects on body forces of the marine vehicle 100. In some embodiments the bladders 110 can be flexible, and in some embodiments the bladders 110 can be substantially rigid.

In some embodiments, the movement of the marine vehicle 100 can be controlled by or derived from inflation and deflation of the bladders 110. More specifically, the inflation and deflation of the bladders 110 can substitute for mechanical actuation to control the movement of the marine vehicle 100 in the water. The bladders 110, for example, can be inflated to increase the buoyancy of the marine vehicle 100, and specifically the area proximate an inflated bladder 110. The bladders 100 can also be deflated to decrease the buoyancy of the marine vehicle 100, and specifically the area proximate a deflated bladder 110.

As shown in FIG. 1, for example, the marine vehicle 100 can comprise one or more control surfaces, such as a left fin 115 and a right fin 120, similar to a batoid. In some embodiments, however, the marine vehicle 100 can comprise additional control surfaces, such as additional fins, stabilizers, tails, and the like. It will be apparent to those of skill in the art that the marine vehicle 100, including the body 105 and control surfaces, can be configured to provide hydrodynamic characteristics of a batoid, such as ease of maneuverability and a sleek hydrodynamic profile.

In some embodiments, one or more of the fins 115, 120 can comprise an inflatable bladder 105. To control the movement of the marine vehicle 100, the bladders 110 on the fins 115, 120 can be inflated and deflated. For example, to cause the marine vehicle 100 to roll right, a bladder 110 on the left fin 115 can be inflated, causing the left side of the marine vehicle 100 to rise. Alternatively, a bladder 110 on the right fin 120 can be deflated, causing the right side of the marine vehicle 100 to descend. To enable the marine vehicle 100 to roll left, a bladder 110 on the right fin 120 can be inflated, or a bladder 110 on the left fin 115 can be deflated. In these cases, a bladder 110 can be inflated or deflated to control the roll of the marine vehicle 100. It will be apparent to those of skill in the art that fins 115, 120 are not necessary to impart the roll movement described above, and that embodiments without fins, but that are capable of roll movement, are envisioned.

Moreover, the inflatable bladders 110 can control the pitch of the marine vehicle. For example, to cause the marine vehicle 100 to pitch nose-up, a bladder 110 on the front of the marine vehicle 100 can be inflated, causing the front of the marine vehicle 100 to rise. Alternatively, a bladder 110 on the back of the marine vehicle 100 can be deflated, causing the rear of the marine vehicle 100 to descend. To enable the marine vehicle 100 to pitch nose-down, a bladder 110 on the back of the marine vehicle 100 can be inflated, or a bladder 110 on front of the marine vehicle 100 can be deflated.

In some embodiments, inflation and deflation of the inflatable bladders 110 can control the yaw of the marine vehicle 100. This control can be imparted by the various bladders 110 and/or control surfaces, as will be apparent to those of skill in the art after reading this disclosure. For example, in some embodiments, by incorporating a collection of smaller bladders 110 into the design, and carefully controlling inflation and deflation of those bladders 110, yaw can be instantiated.

As described above, the movement of the marine vehicle 100 can be controlled by varying the buoyancy of the marine vehicle 100, and/or specific areas of the marine vehicle 100 (such as fins 115, 120), by inflation and deflation of the bladders 110. As shown in FIG. 1, the marine vehicle 100 can therefore comprise a plurality of bladders 110 that extend along certain areas of the marine vehicle 100. In some embodiments, the volume of the bladders 110 can be individually adjusted by inflation and deflation. In some embodiments, these bladders 110 can extend along the left fin 115, right fin 120, or both of the marine vehicle 100. In some embodiments, the bladders 110 can extend along the upper camber of the fins 115, 120 of the marine vehicle 100.

In addition to fins 115, 120, bladders 110 can be disposed on several other control surfaces of the marine vehicle 100. For example, bladders 100 can be disposed on stabilizers, flukes, flippers, tails, and the like. These bladders 110 can provide control, stability, and locomotion capabilities to the marine vehicle 100.

Figure 2:
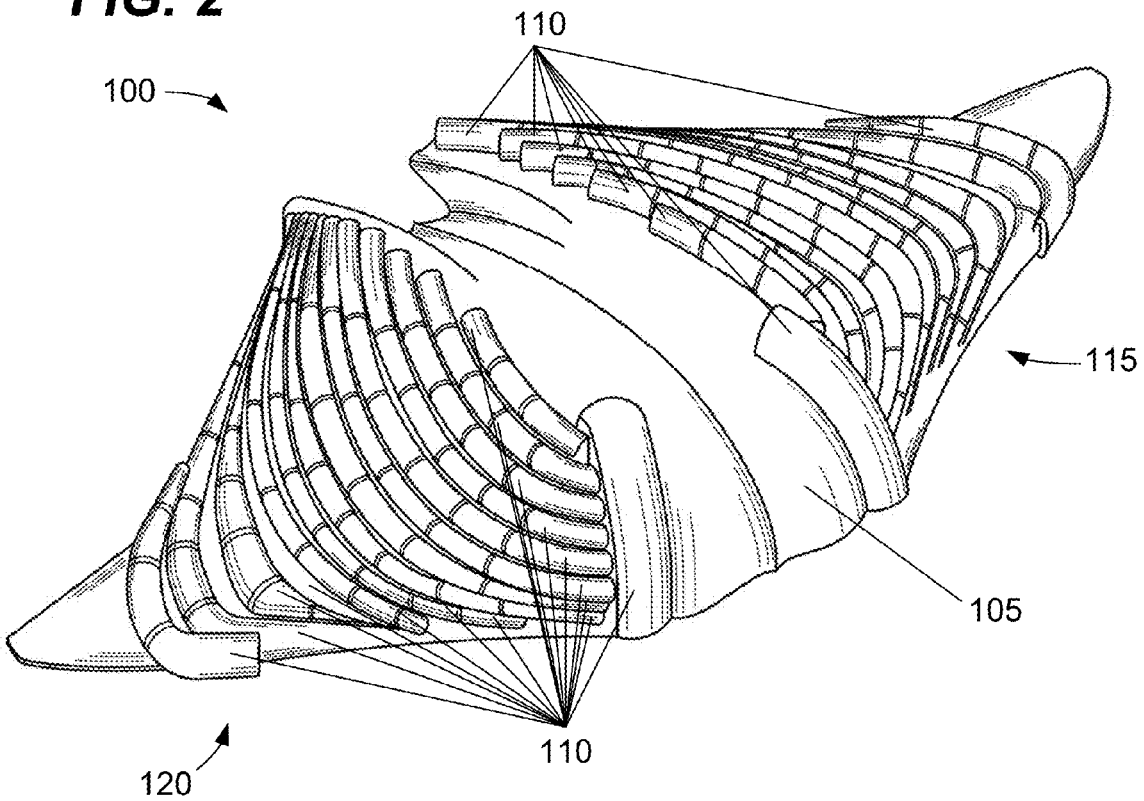
FIG. 2 depicts a marine vehicle comprising segmented inflatable bladders, in accordance with some embodiments of the present invention.

As shown in FIGS. 2 and 3, in some embodiments, the bladders 110 can be smaller than the bladders 110 shown in FIG. 1, and can be segmented. The bladders 110, for example, can be segmented portions of a larger tube-like assembly that comprises multiple bladders 110, as shown in FIG. 2. Alternatively, the bladders can be smaller individual bladders 110 that are not connected to other bladders 110, as shown in FIG. 3. In some embodiments, using smaller or segmented bladders 110 can provide enhanced controllability of the marine vehicle 100. More specifically, using smaller or segmented bladders 110 can enable finer adjustment of control surfaces, and can enable more precise control of buoyancy forces.

Figure 4:
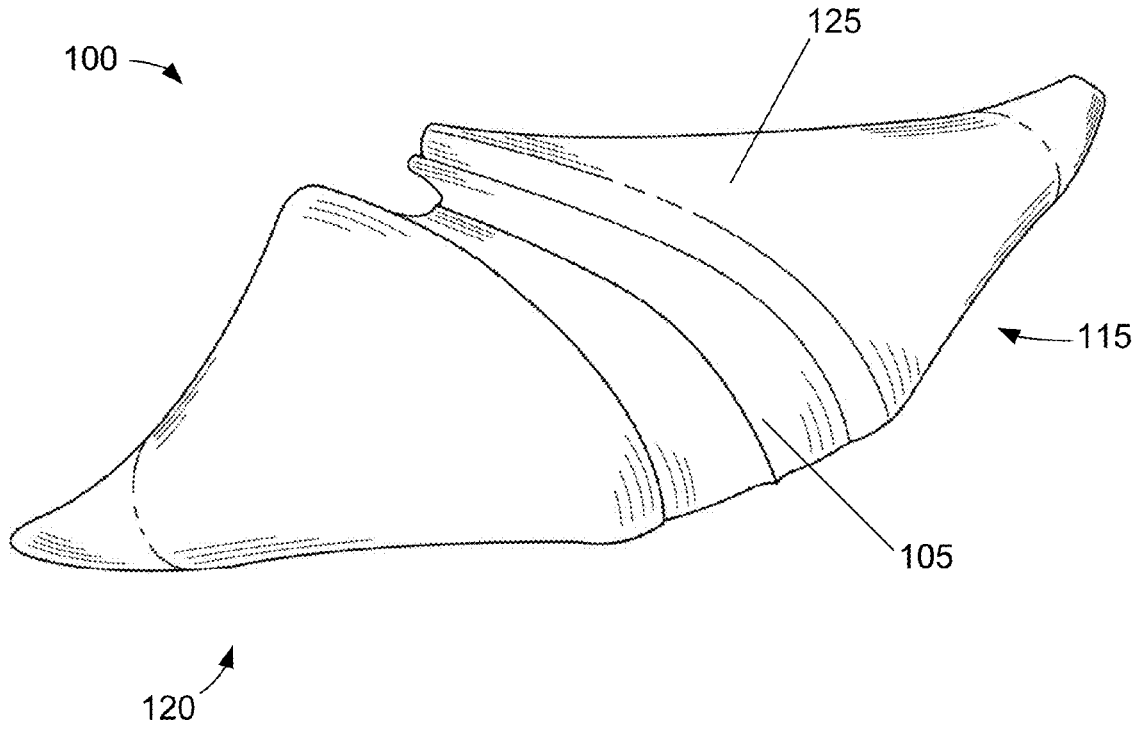
FIG. 4 depicts the marine vehicle of FIG. 1 or FIG. 2 with an exterior cover, in accordance with some embodiments of the present invention.
Figure 5:
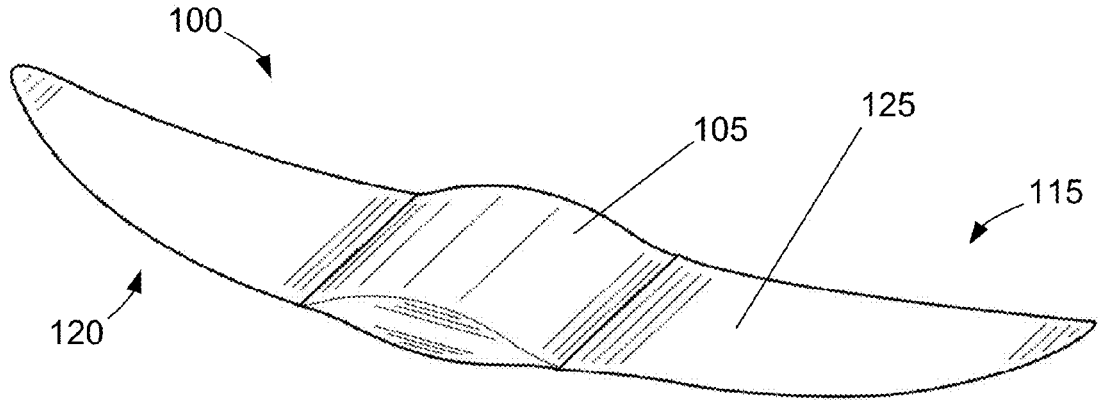
FIG. 5 depicts the marine vehicle of FIG. 3 with an exterior cover, in accordance with some embodiments of the present invention.

As shown in FIGS. 4 and 5, in some embodiments, the marine vehicle 100 can comprise a skin or cover 125. The cover 125 can be an exterior layer and can enhance the hydrodynamic properties of the marine vehicle 100. More specifically, the cover 125 can prevent the bladders 110, or any other components, such as non-hydrodynamic components, from being exposed to the flow of fluid around the marine vehicle 100. The cover 125 can therefore reduce the drag created by the marine vehicle 100 as it moves through the water, thereby increasing efficiency of the marine vehicle 100 and extending the maximum length of missions. In some embodiments, the cover 125 can be disposed over at least one control surface of the marine vehicle 100.

In some embodiments, moreover, the cover 125 can house embedded sensors. For example, sensors such as pressure sensors, temperature sensors, cameras, and the like can be embedded in the cover 125. In some embodiments, one or more sensors can be integrated into the cover 125, and in some embodiments one or more sensors can be on an interior or exterior surface of the cover 125.

An advantage of the marine vehicle 100 disclosed herein is that it can ascend or descend in the water without expending additional fuel, e.g., after activating a bladder 110 to put the marine vehicle 100 into a controlled motion. In other words, one or more of the bladders 110 can be inflated or deflated to adjust the buoyancy of the marine vehicle 100 such that it will ascend or descend. Once this buoyancy is achieved, there is little, if any need to expend additional energy during ascent or dissent, whereby buoyancy differentials are exploited. This provides an advantage over conventional systems that use mechanical actuation, or propellers, to control ascent or descent, as these designs must use energy throughout these processes.

In some embodiments, in addition to controlling roll, pitch, and yaw, as described above, buoyancy can be used to control lateral movement of the marine vehicle 100. In embodiments comprising fins 115, 120, for example, the fins 115, 120 can be flappable, i.e., the fins 115, 120 can be flapped to impart motion to the marine vehicle 100, similar to a batoid. This motion can be forward, backward, side-to-side, upward, or downward, or combinations thereof, for example and not limitation. The fins 115, 120 can therefore comprise a flexible material that enables buoyancy controlled flapping. Moreover, the fins 115, 120 can comprise a material that is more dense than water, enabling the fins 115,120 to descend in the water, or flap downward, when bladders 110 on the fins 115, 120 are deflated, and to ascend in the water, or flap upward, when bladders 110 on the fins 115, 120 are inflated.

One method of imparting forward motion to the marine vehicle 100 is described with reference to FIGS. 6*a*-6*d*. Each of FIGS. 6*a*-6*d* shows a cross section of a fin 115, 120 that comprises a flexible hydrofoil.

Figure 6:
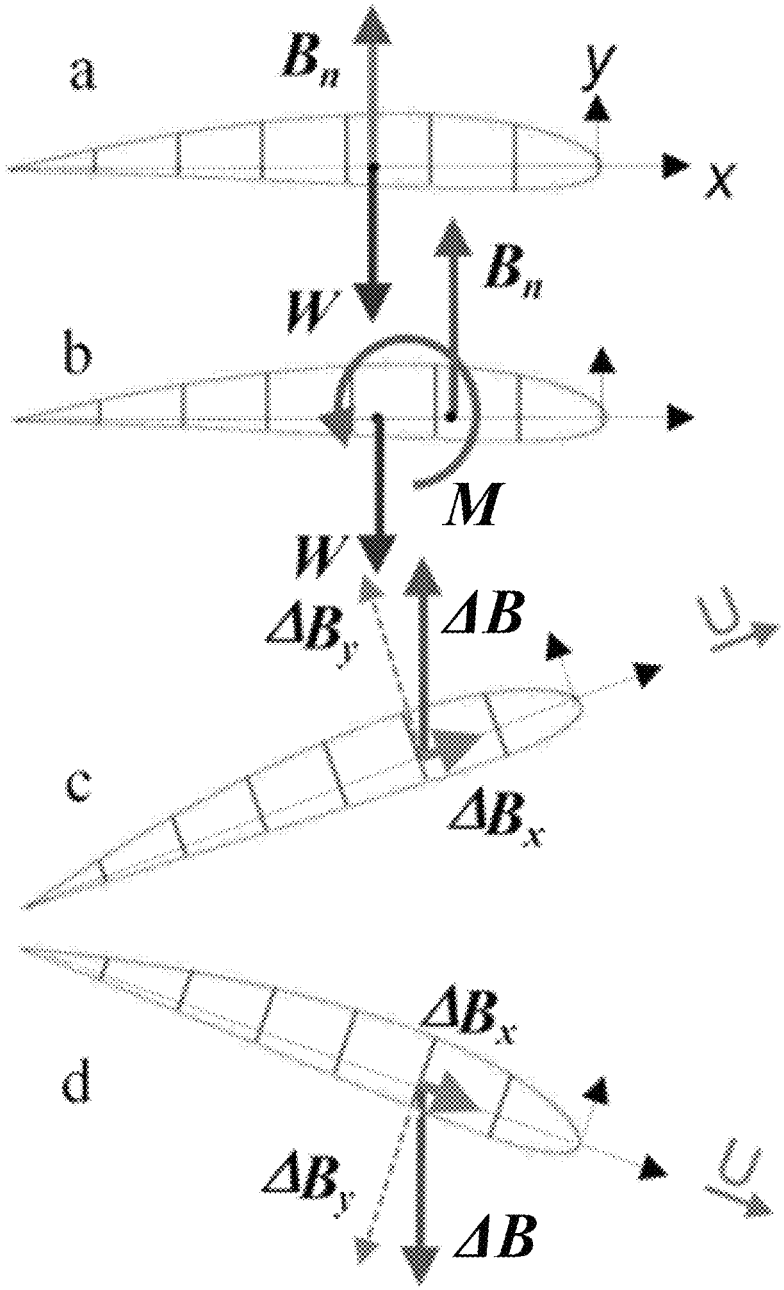
FIGS. 6*a*-6*d* depict cross sections of a fin comprising a flexible hydrofoil, in accordance with some embodiments of the present invention.
Figure 7A:
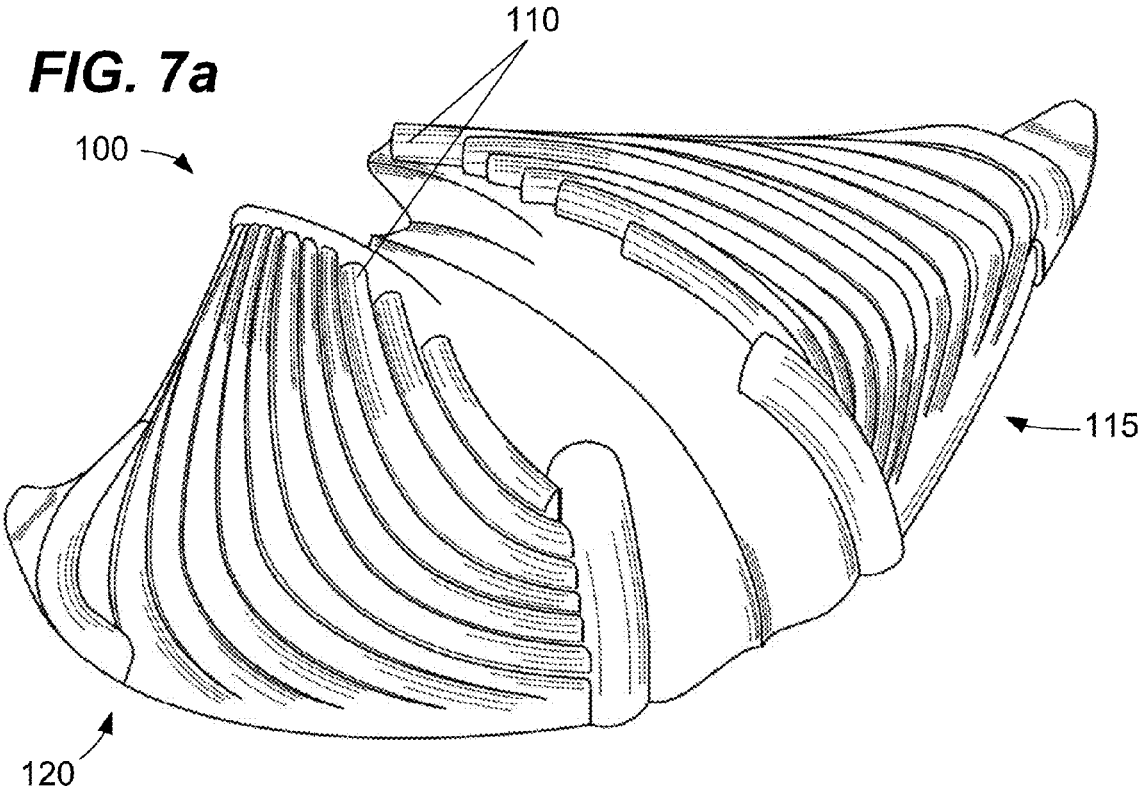
FIG. 7*a* depicts the marine vehicle of FIG. 1 with fins in an upward flapping position, in accordance with some embodiments of the present invention.

Initially, the marine vehicle 100 can be at rest and neutrally buoyant, as shown in FIG. 6*a*. Neutral buoyancy can be achieved by adjusting the resultant neutral buoyancy force $B_n$ to balance the fixed resultant weight W of the marine vehicle 100. The line of action of $B_n$ can then be moved toward the leading edge of the fin 115, 120 by inflation of one or more bladders 110 that can be located close to the leading edge of the fin 115, 120. This shift can induce a pitching moment M, as shown in FIG. 6*b*, that can itself induce an upward turning of the fins 115, 120 and/or marine vehicle 100. This can result in an upward flap of the fins 115, 120, as shown in FIG. 7*a*.

When a desired angle is reached, $B_n$ is increased by $\Delta B$, which has two components in the hydrofoil's frame of reference: $\Delta B_x$ along the chord and $\Delta B_y$ normal to the chord. These components may be thought of as propulsive and lift forces, respectively, as shown in FIG. 6*c*. As a result of these forces, the fin 115, 120 and/or marine vehicle 100 can begin to move in both directions, i.e., parallel to the chord and normal to the chord. The hydrodynamic resistance to motion in the y direction, however, can be inherently much larger than in the x direction due to hydrodynamic forces on the marine vehicle 100, and therefore motion can be primarily restricted to the x direction.

Figure 7B:
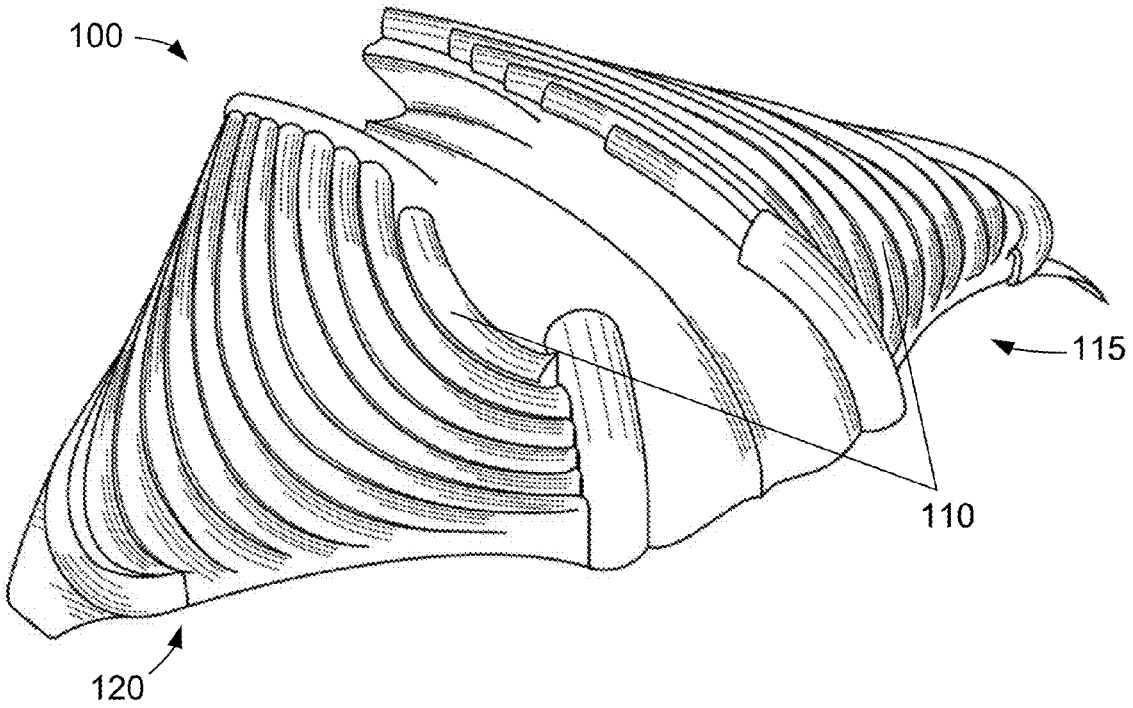
FIG. 7*b* depicts the marine vehicle of FIG. 1 with fins in a downward flapping position, in accordance with some embodiments of the present invention.

In some embodiments, the bladders 100 can be deflated to reverse the forces on the fins 115, 120 so that the hydrofoil is pitched in an opposite direction, as shown in FIG. 6*d*. This can result in a downward flap of the fins 115, 120, as shown in FIG. 7*b*. As a result of the downward flap, in some embodiments, the marine vehicle 100 can continue to be propelled by the force in the x direction. Accordingly, in some embodiments, forward motion of the marine vehicle 100 can be generated by vertical heaving that is induced by prescribed, time-dependent changes in the balance between the buoyancy and weight of the marine vehicle 100.

Similar motions to those described above can be used to impart backward motion and side-to-side motion to the marine vehicle 100, as will be understood by those of skill in the art after reading this disclosure. For example, to impart backward motion, the line of action of $B_n$ can be moved toward the trailing edge of the fin 115, 120 by inflation of one or more bladders 110 located near the trailing edge. This shift can induce a pitching moment opposite to M, and the rest of the flapping process can essentially be repeated in reverse, to impart backward movement.

Figure 8:
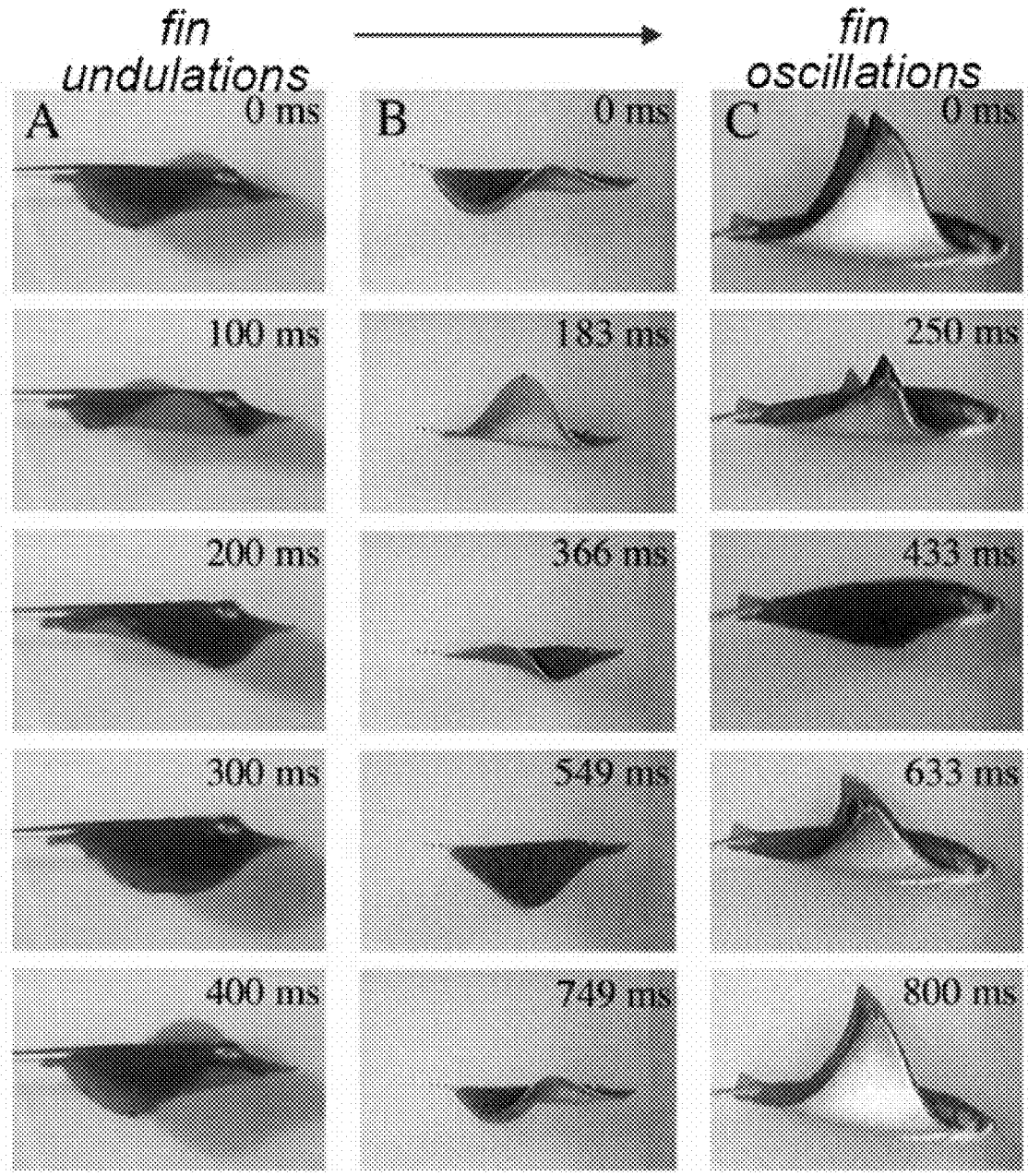
FIGS. 8A-8C are pictures of batoids flapping their fins in undulation-type motions, oscillation-type motions, and motions between undulations and oscillations.

In some embodiments, the flapping motion of the fins 115, 120 can take a variety of forms. As shown in FIGS. 8A-8C, for example, batoids can flap their fins in several different motions. FIG. 8A shows that some batoids employ fin undulations, for example, which are small waves of the fins used to impart movement to the batoid. FIG. 8C shows that some batoids employ fin oscillations, which are large flaps of the fins also used to impart movement to the batoid. FIG. 8B shows that some batoids employ fin movements between undulations and oscillations.

Embodiments of the present invention can employ both undulations and oscillations, and movements in between, to impart movement to the marine vehicle 100. Thus, bladders 110 on the fins 115, 120 can be inflated and deflated to enable the fins 115, 120 to undulate or oscillate, or to undergo motions in between. Moreover, the fins 115, 120 can be configured to flap in undulation-type movements, oscillation-type movements, or both.

When undulations are used to impart movement to the marine vehicle 100, speed of the marine vehicle 100 can be modified by changing the undulation speed and/or frequency. When oscillations are used to impart movement to the marine vehicle 100, speed of the marine vehicle 100 can be generally proportional to fin tip speed. Accordingly, as the speed of the oscillations increases, and thus the fin tip speed increases, the speed of the marine vehicle 100 can also increase.

As explained in detail above, embodiments of the present invention can comprise a marine vehicle 100 wherein movement is controlled by underwater inflation and deflation of inflatable bladders 110. The bladders 100 can be inflated and deflated in a number of ways.

In some embodiments, for example, to inflate one or more bladders 110, the marine vehicle 100 can comprise one or more canisters of compressed gas. The canister can be stored, for example and not limitation, in a cavity of the body 105 of the marine vehicle 100. Moreover, the canister can be in fluid communication with a bladder 110 such that the marine vehicle 100 can be configured to controllably and pneumatically deliver at least some of the gas from the canister to one or more of the bladders 110. In other words, gas from the canister can be delivered to the bladders 100 to inflate the bladders 110. The gas can be delivered, for example, through one or more conduits, such as tubes, and flow of the gas can be controlled by one or more valves. Due to minimal electric and mechanical requirements, this method of inflation and deflation of the bladders 110, which can enable movement of the marine vehicle 100, can be more efficient than traditional methods of inducing vehicle movement, such as mechanical actuation of control surfaces, propellers, and the like.

In some embodiments, inflation of the bladders 110 can be accomplished by a chemical reaction that increases the number of moles inside the bladder 110. An azide, for example, can be disposed within one or more of the bladders 110, and electricity or heat can be delivered to the azide to cause the azide to transform to a gaseous state. The resulting gas can comprise more moles than the solid, and can inflate the bladder 110. In some embodiments, sodium azide ($NaN_3$) can be the azide disposed within at least one of the bladders 110. Upon heating, at least a portion of the sodium azide can decompose into nitrogen gas and, when the azide is mixed with additional oxidizers such as potassium nitrate and silicon dioxide, can leave behind a non-toxic silicate solid reaction product. Sodium azide can survive for years under extreme temperatures and conditions, and is therefore a suitable azide for use during extended missions Another azide that can be used is glycidyl azide polymer (GAP) ($C_3H_5ON_3$). GAP can be a liquid that can be injected into small combustion chambers and hardened in place. GAP is liquid at room temperature, in a prepolymer form. GAP can be polymerized to form a copolymer by reacting the terminal —OH groups with hexamethylene diisocyanate and crosslinked with trimethylolpropane. Because it is a liquid that can be hardened with the addition of a curing agent, GAP can readily be dispensed into bladders 110, eliminating the need for presses and molds to form solid propellant grains.

In some embodiments, the chemical reaction involving an azide can be represented by:

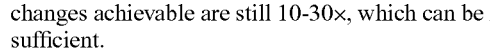

$$2XN_3(\text{solid})+\text{heat}\rightarrow 2X+3N_2(\text{gas})$$

where X is the counterion, such as, for example, sodium. The gas generation capability of azides can be quite large. Factors of 100-300× increase of volume, for example, are achievable using azides. These volume increases will be reduced as depth increases, since the pressure outside the bladders 110 will increase. However, even at depths of 100-300 m, the volume changes achievable are still 10-30×, which can be more than sufficient.

Figure 9:
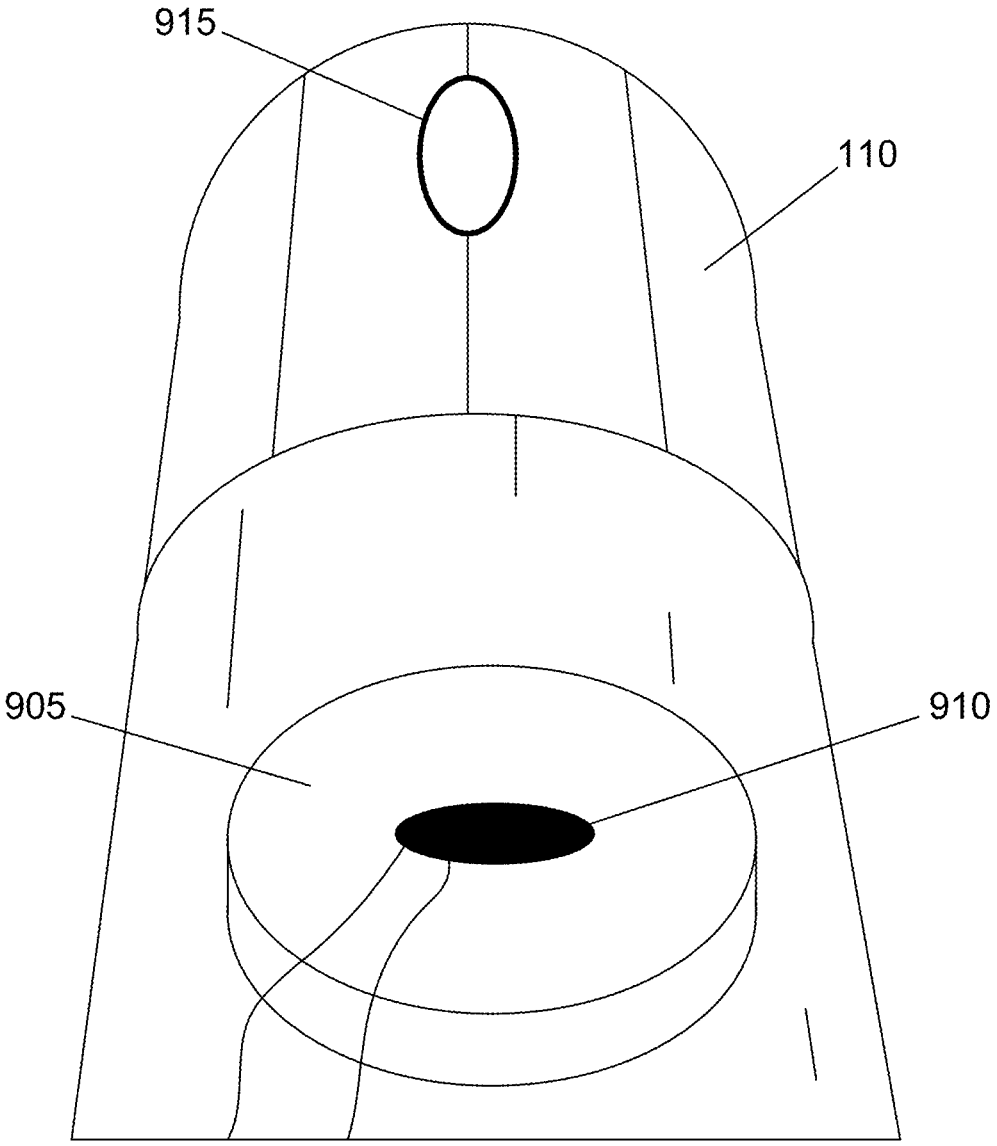
FIG. 9 depicts a cutaway, internal view of a bladder with an azide disposed therein, in accordance with some embodiments of the present invention.

FIG. 9 shows a cutaway view of a bladder 110 with an azide precursor 905 disposed therein. In some embodiments, the azide precursor 905 can comprise a solid, such as a sodium azide block or puck. An activation system 910 can also be positioned in communication with the azide precursor 905. In some embodiments, the activation system 910 can comprise an igniter. In some embodiments, the activation system 910 can comprise electrical wiring that delivers heat or a charge to the azide. To initiate a transformation of the azide precursor 905 from solid to gas, a signal, such as, for example, an electric signal, can be delivered to the activation system 910, which can then heat the precursor 905 or deliver an electric charge to the precursor 905. The heat or charge can initiate a chemical reaction that can produce gas, such as nitrogen gas, to inflate the bladder 110. The inflated bladder 110 can then be less dense that the surrounding water, and can therefore rise.

In some embodiments, the azide precursor 905 and activation system 910 can be configured to exhaust, or use substantially the entirety of, the precursor 905 when the activation system 910 receives a signal. In these embodiments, exhaustion of the precursor 905 can produce enough gas to fully inflate the bladder 110. Moreover, in these embodiments, the bladder 110 can comprise a plurality of precursors 905 and a plurality of activation systems 910. Accordingly, the bladder 110 can be inflated and deflated multiple times without the need to replace a precursor 905.

In other embodiments, the azide precursor 905 and activation system 910 can be configured to slowly transform the precursor 905 to gas as the signal is delivered to the activation system 910. In these embodiments, the precursor 905 is not necessarily exhausted, and the bladder 110 is not necessarily fully inflated, each time the activation system 910 receives a signal. Instead, heat or electricity will be delivered to the precursor 905, and the precursor 905 will relatively slowly transform to gas, for the duration of the time the signal is delivered. When the signal ceases to be delivered to the activation system 910, the precursor 905 will stop transforming to gas. Accordingly, the amount of gas produced, and thus the level of inflation of the bladder 110, can be carefully controlled. Moreover, a smaller number of precursors 905 can be required.

The azide systems described above can provide a relatively simple, yet effective way to inflate a bladder 110. Moreover, these systems can obviate the need for mechanical actuation of the fins 115, 120, thereby simplifying the mechanics of the marine vehicle 100.

In addition to reactions involving azides, other chemical reactions can be used to inflate the bladders. For example, thermal decomposition of ammonium nitrate can be used, as well as water-induced decomposition of carbides. In some embodiments, decomposition of water using thick films of passivated alkali metals or salts to produce $H_2$ gas can also be used.

Embodiments of the present invention also comprise systems for enabling the deflation of the bladders 110. As shown in FIG. 9, for example, in some embodiments, a bladder 110 can comprise a valve 915 in fluid communication with the interior of the bladder 110. The valve 915 can be, for example and not limitation, a microvalve, and can be an active valve, passive valve, or combination thereof. In some embodiments, the valve 915 can comprise a valve system with a passive valve supplemented by an active valve. The valve 915 can remain in a closed state until it is desirable for the bladder 110 to fully or partially deflate. The valve 915 can then be opened, providing an exit for all or some of the gas within the bladder 110.

Egress of the gas from the bladder 110 can be facilitated in a number of ways. In some embodiments, for example, the valve 915 can be disposed on an upward facing side of the bladder 110. In other words, the valve 915 can be disposed on a side of the bladder 110 that usually faces upward toward the surface of the water. In this manner, when the valve 915 is opened, the gas will tend to "float" out of the bladder 110. In addition, in embodiments where the bladder is flexible, as opposed to rigid, the surrounding water can exert pressure on the bladder 110. This can cause the bladder 110 to be compressed inward when the valve 915 is opened, causing the gas to be squeezed out of the bladder 110.

Moreover, in some embodiments, the bladder 110 can comprise a flexible, elastic material. The elastic material can expand when the bladder 110 is inflated, similar to a balloon. When the valve 915 is opened, however, the elastic material can provide a compressive force that helps to squeeze the gas out of the bladder 110. Use of elastic materials can help ensure that the bladder 110 is completely deflated when so desired.

In some embodiments, each bladder 910 can comprise an inflation system, such as an azide 905, and a deflation system, such as a valve 915. Accordingly, in embodiments comprising segmented or smaller bladders 110, as shown in FIGS. 2 and 3, each of the bladders 910 can comprise an inflation system and a deflation system. Thus, in some embodiments, each of the bladders 110 can inflate on demand and deflate on demand.

As described above, the marine vehicle 100 can comprise a flexible material that prevents the marine vehicle 100 from damaging delicate portions of the marine environment, such as corals and ice structures. The flexible construction of the marine vehicle 100, however, can provide additional advantages. For example, one problem with known marine vehicles is that they expend a large amount of energy transporting themselves to areas they will explore. It would therefore be convenient if a marine vehicle could be delivered to an area without expending energy.

Figure 10:
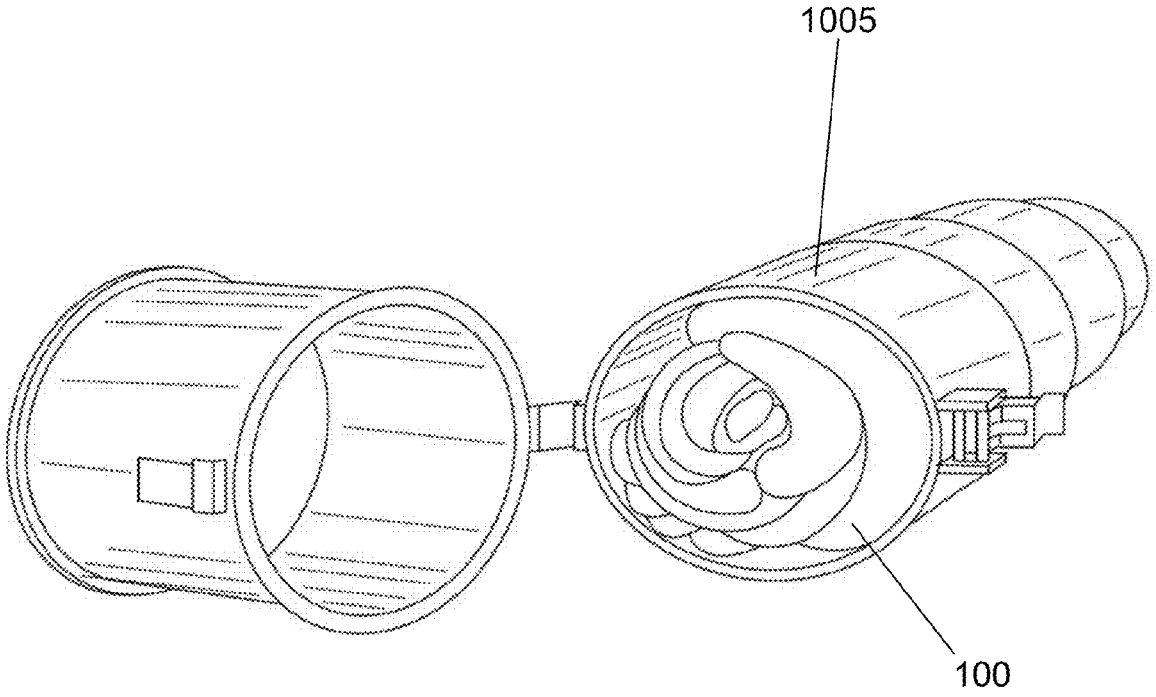
FIG. 10 depicts a marine vehicle in a storage container, in accordance with some embodiments of the present invention.

As shown in FIG. 10, in some embodiments, the marine vehicle 100 can be stored in a storage container 1005. More specifically, in some embodiments, the marine vehicle 100 can be sufficiently flexible to be rolled or folded up and inserted into a storage container 1005, such as a delivery tube or a riser canister. The storage container 1005 can then be delivered to a desired location, where it can be opened, enabling the marine vehicle 100 to emerge from the container 1005 and perform a mission. In some embodiments, the storage container 1005 can be opened remotely, i.e., via remote control. As described above, this type of delivery can enable the marine vehicle 100 to conserve a significant amount of energy.

Embodiments of the present invention can further comprise a control system. The control system can comprise hardware and software that enables control of the marine vehicle 100. In some embodiments, the control system can use low level controller logic to control the movement of the marine vehicle 100.

Figure 11:
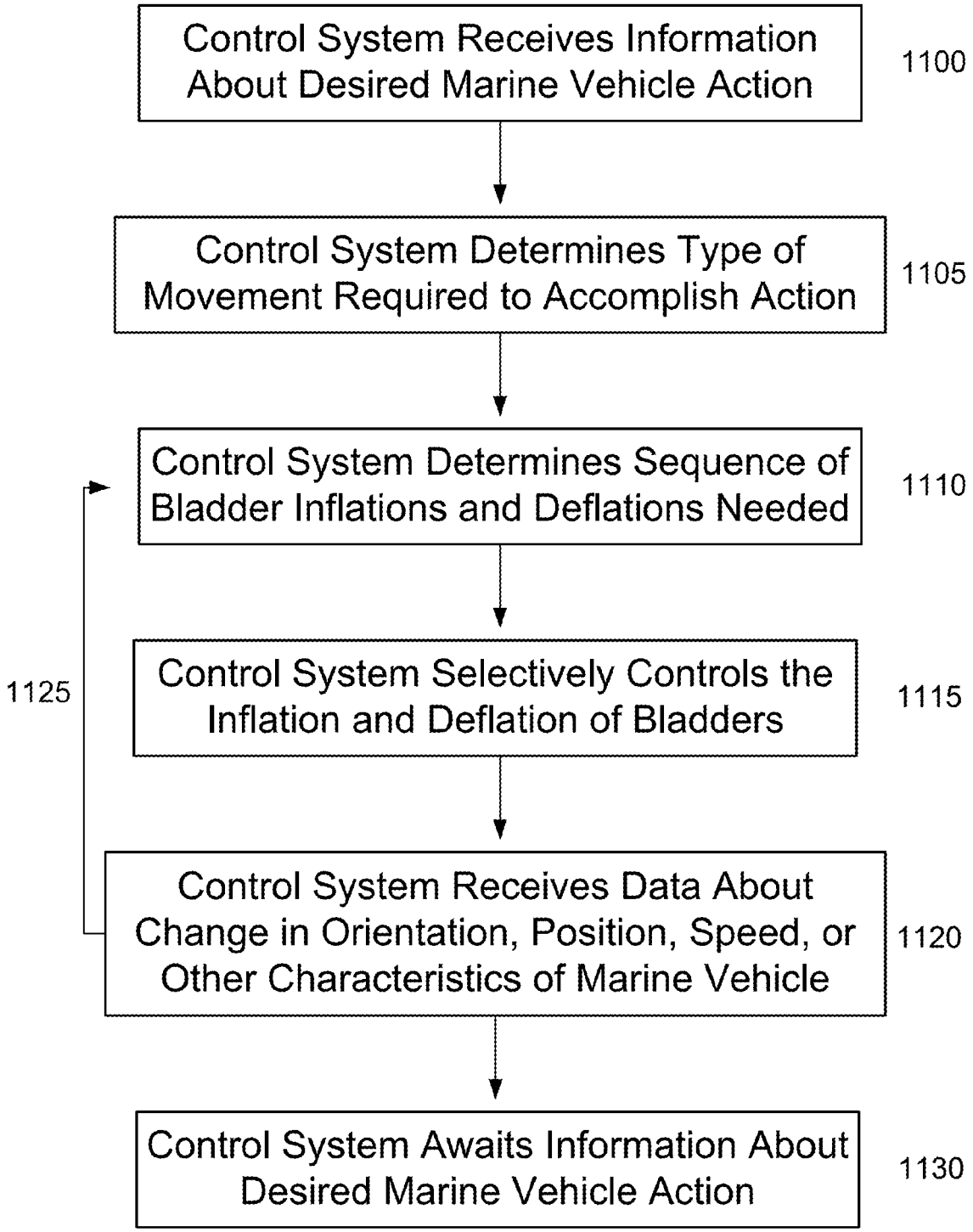
FIG. 11 is a flow chart depicting a method for controlling a marine vehicle, in accordance with some embodiments of the present invention.

As shown in FIG. 11, at step 1100, the control system can receive information about a desired action of the marine vehicle 100. The desired action can be, for example and not limitation, a translation or rotation of the marine vehicle 100, or a movement to a particular location. At step 1105, the control system can determine the type of movement that is required to accomplish the desired action. In other words, the control system can determine what type of translation, rotation, forward, backward, upward, downward, or side-to-side movement, or combination thereof, is required.

At step 1110, the control system can determine the sequence of bladder 110 inflations and deflations needed to initiate, undergo, and complete the movement. At step 1115, the control system can then selectively control the inflation and deflation of one or more bladders 110 to enable the movement. After some period of time, the control system can then receive data about the resulting change in orientation, position, and/or speed of the marine vehicle 100, as shown by step 1120. The control system can then use that data to reevaluate the sequence of bladder inflations and deflations needed to undergo and complete the movement, as shown by feedback loop 1125.

When the movement required to accomplish the action is complete, the control system can await further information about other desired marine vehicle actions, as shown by step 1130. In some embodiments, the control system can ensure that the marine vehicle 100 maintains a constant position and orientation while it is awaiting further information.

In some embodiments, the control system can receive information about a desired marine vehicle action via remote control. More specifically, in some embodiments, a person or system can remotely send the marine vehicle 100, i.e. the control system, information about a desired action, and the control system can help enable the marine vehicle 100 to carry out that action.

The control system described above can control several movements of the marine vehicle 100. In some embodiments, for example, the control system can selectively inflate and deflate bladders 110 to enable desired roll, pitch, and yaw movements of the marine vehicle 100. Moreover, in some embodiments, the control system can selectively inflate and deflate bladders 110 to enable the marine vehicle 100 to travel along a desired trajectory.

Although scalable to nearly any size, in some embodiments, the marine vehicle 100 can have a wing span of about 50 cm, and a length of about 30 cm. However, the marine vehicle 100 can have a wing span several meters wide, and can be several meters long. Alternatively, the wing span can be just a few centimeters wide, and can be just a few centimeters long. Indeed, all sizes of the marine vehicle 100 are envisioned.

While several possible embodiments are disclosed above and throughout this specification, embodiments of the present invention are not so limited. For instance, while several possible marine vehicles and methods of marine transportation have been provided, other suitable vehicles, methods of transportation, or combinations could be selected without departing from the spirit of embodiments of the invention. In addition, the configuration used for various features of embodiments of the present invention can be varied according to the particular requirements of a mission or marine environment. Such changes are intended to be embraced within the scope of the invention.

The specific methods, method steps, systems, and other embodiments disclosed can be varied according to particular needs. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A marine vehicle comprising:

a body; and a plurality of inflatable bladders;

wherein at least one bladder of the plurality of inflatable bladders selectively inflates and deflates underwater to control movement, including forwards or backwards propulsion, of the marine vehicle.

2. The marine vehicle of claim 1, wherein at least one bladder of the plurality of inflatable bladders is configured to be inflated underwater to control the roll of the marine vehicle.

3. The marine vehicle of claim 1, wherein at least one bladder of the plurality of inflatable bladders is configured to be inflated underwater to control the pitch of the marine vehicle.

4. The marine vehicle of claim 1, wherein at least one bladder of the plurality of inflatable bladders comprises an elastic material.

5. The marine vehicle of claim 1 further comprising an azide disposed within at least one bladder of the plurality of inflatable bladders.

6. A marine vehicle comprising:

a body; and a plurality of control surfaces, at least one control surface of the plurality of control surfaces comprising an inflatable bladder; and a control system that selectively inflates and deflates the inflatable bladder underwater to control movement of the control surface to propel the marine vehicle in a forwards or backwards direction.

7. The marine vehicle of claim 6 further comprising an azide disposed within the inflatable bladder.

8. The marine vehicle of claim 7, wherein heat is provided to the azide to cause at least a portion of the azide to transform to a gaseous state.

9. The marine vehicle of claim 6 further comprising a canister of compressed gas, and wherein the marine vehicle is configured to deliver at least some of the gas from the canister to the inflatable bladder.

10. The marine vehicle of claim 6 further comprising a valve in fluid communication with the inflatable bladder.

11. The marine vehicle of claim 6 further comprising a payload compartment.

12. The marine vehicle of claim 6 further comprising a cover disposed over at least one control surface of the plurality of control surfaces.

13. The marine vehicle of claim 6, wherein the control system selectively inflates and deflates the inflatable bladder based at least in part on a desired trajectory for the marine vehicle.

14. The marine vehicle of claim 6, wherein at least two of the control surfaces are flappable fins.

15. The marine vehicle of claim 6, wherein the marine vehicle can be rolled and inserted into a storage container.

16. A marine vehicle comprising:

a body; and a plurality of flappable fins, each of the plurality of fins comprising a plurality of inflatable bladders;

wherein at least one bladder of the plurality of inflatable bladders selectively inflates and deflates underwater to control a flapping motion of at least one fin of the plurality of flappable fins to impart forwards or backwards propulsion to the marine vehicle.

17. The marine vehicle of claim 16, wherein at least one fin of the plurality of flappable fins is configured to flap in an undulating motion.

18. The marine vehicle of claim 16, wherein at least one fin of the plurality of flappable fins is configured to flap in an oscillating motion.

19. The marine vehicle of claim 16 further comprising an azide disposed within each of the inflatable bladders, the marine vehicle configured to deliver heat to each of the azides to cause at least a portion of each azide to transform to a gaseous state.

20. The marine vehicle of claim 16, wherein the at least one bladder selectively inflates to cause an upward flap of the at least one fin or selectively deflates to cause a downward flap of the at least one fin.

* * * * *